US007641745B2

(12) United States Patent
Hirose et al.

(10) Patent No.: US 7,641,745 B2
(45) Date of Patent: Jan. 5, 2010

(54) SOFT MAGNETIC MATERIAL AND METHOD OF PRODUCING POWDER COMPACT

(75) Inventors: Kazuhiro Hirose, Itami (JP); Haruhisa Toyoda, Itami (JP); Takao Nishioka, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 313 days.

(21) Appl. No.: 11/909,962

(22) PCT Filed: Mar. 29, 2005

(86) PCT No.: PCT/JP2005/005890

§ 371 (c)(1),
(2), (4) Date: Sep. 27, 2007

(87) PCT Pub. No.: WO2006/106566

PCT Pub. Date: Oct. 12, 2006

(65) Prior Publication Data

US 2008/0253917 A1 Oct. 16, 2008

(51) Int. Cl.

| | |
|---|---|
| ***H01F 1/147*** | (2006.01) |
| ***H01F 1/20*** | (2006.01) |
| ***H01F 1/22*** | (2006.01) |
| ***H01F 1/24*** | (2006.01) |

(52) U.S. Cl. ..... 148/306; 148/104

(58) Field of Classification Search ..... None
See application file for complete search history.

(56) References Cited

U.S. PATENT DOCUMENTS

| | | | | |
|---|---|---|---|---|
| 3,999,216 | A * | 12/1976 | Berchtold | 360/125.01 |
| 2004/0258552 | A1 | 12/2004 | Shimada et al. | |
| 2008/0253917 | A1* | 10/2008 | Hirose et al. | 419/66 |

FOREIGN PATENT DOCUMENTS

| | | | |
|---|---|---|---|
| JP | 7-245209 | A | 9/1995 |
| JP | 9-512388 | A | 12/1997 |
| JP | 10-503807 | A | 4/1998 |
| JP | 2001-102207 | A | 4/2001 |
| JP | 2002-246219 | | 8/2002 |
| JP | 2003-129104 | A | 5/2003 |
| JP | 2005-129716 | A | 5/2005 |
| JP | 2005-146315 | A | 6/2005 |
| WO | 03/038843 | A1 | 5/2003 |

OTHER PUBLICATIONS

Patent Abstracts of Japan Publication No. 09-256004, dated Sep. 30, 1997, 5 pages.
Patent Abstracts of Japan Publication No. 08-060288, dated Mar. 5, 1996, 10 pages.
Patent Abstracts of Japan Publication No. 2004-071860, dated Mar. 4, 2004, 8 pages.
Office Action in Japanese Patent Application No. 2004-062141, dated Jun. 24, 2008, 4 pages; partial English translation thereof, 5 pages.
Patent Abstracts of Japan, Publication No. 2001-102207, dated Apr. 13, 2001, 1 page.
Patent Abstracts of Japan, Publication No. 2003-129104, dated May 8, 2003, 1 page.

(Continued)

*Primary Examiner*—John P. Sheehan
(74) *Attorney, Agent, or Firm*—Osha•Liang LLP

(57) ABSTRACT

A soft magnetic material used for producing a powder compact has a plurality of iron particles having a Vickers hardness HV of less than 800 and satisfying the relationship of $\alpha/\beta \geqq 2.5$, where $\alpha$ represents the specific surface area of the iron particles measured by a gas adsorption method (Brunauer-Emmett-Teller (BET) method) and $\beta$ represents the apparent specific surface area of the iron particles calculated from the average particle diameter measured by a laser diffraction/scattering method.

10 Claims, 6 Drawing Sheets

OTHER PUBLICATIONS

Patent Abstracts of Japan, Publication No. 2002-246219, dated Aug. 30, 2002, 1 page.
Patent Abstracts of Japan, Publication No. 07-245209, dated Sep. 19, 1995, 2 pages.
Patent Abstracts of Japan, Publication No. 2005-129716, dated May 19, 2005, 1 page.
Patent Abstracts of Japan, Publication No. 2005-146315, dated Jun. 9, 2005, 1 page.
International Search Report issued in PCT/JP2005/005890, mailed Jul. 19, 2005, 3 pages.

* cited by examiner

SOFT MAGNETIC MATERIAL AND METHOD OF PRODUCING POWDER COMPACT

TECHNICAL FIELD

The present invention generally relates to a soft magnetic material and a method of producing a powder compact, and more particularly to a soft magnetic material containing a plurality of iron particles and a method of producing a powder compact.

BACKGROUND ART

Recently, dust cores that exhibit excellent magnetic characteristics over a broad frequency range have been increasingly used instead of electromagnetic steel plates in production of solenoid valves and motors. Such dust cores and a production method thereof are disclosed, for example, in Japanese Unexamined Patent Application Publication No. 2002-246219 (Patent Document 1). According to the method of producing dust cores disclosed in Patent Document 1, atomized iron powder covered with a phosphate film is first mixed with a predetermined amount of polyphenylene sulfide (PPS resin) and then subjected to a pressure-forming process. The resulting compact is heated in air at 320° C. for one hour and then heated at 240° C. for another hour. The compact is then cooled to produce a dust core. The powder compact, which is obtained by pressure-forming of iron powder, may be used also as a structural material in production of mechanical components and others besides the magnetic components described above. Patent Document 1: Japanese Unexamined Patent Application Publication No. 2002-246219

DISCLOSURE OF INVENTION

PROBLEMS TO BE SOLVED BY THE INVENTION

In typical production processes of such a powder compact, iron particles purified by atomizing methods or reduction methods are used. In the atomizing methods, an iron solution is sprayed using compressed gas or water, and then the resulting iron powder is subjected to pulverization, classification and other processes to produce iron particles. On the other hand, in the reduction methods, iron ore and mill scale are reduced using coke, and then heated under a hydrogen atmosphere to produce iron particles. Therefore, iron particles purified using these methods would have been rapidly cooled in their production process. This causes severe strain or extreme stress to occur inside the iron particles, thereby increasing the hardness of the resulting iron particles. That is why iron particles having a Vickers hardness HV from about 800 to 1100 are used in actual production processes of the powder compact.

The powder compact acquires integrity through entanglement of iron particles caused by their plastic deformation in the pressure-forming process. In a sintered compact, the integrity is relatively improved by formation of metal bonds between the particles and dispersion occurring in the sintering process, but in the powder compact (in particular, a dust core), the heating temperature used in the heating process is so low that sintering between the particles hardly occurs, and thus the strength of bonds between the particles is insufficient. Consequently, more complex entanglement of iron particles in the pressure-forming process is required for producing a powder compact with a high integrity.

However, the hardness of the iron particles used in production of a powder compact is high as described above. The high hardness makes plastic deformation of the iron particles in the pressure-forming process difficult to progress, thereby making the iron particles difficult to entangle This results in insufficient integrity of the powder compact and thus raises several issues such as dropout of the iron particles from the surface of the powder compact and damage of the compact occurring in a cutting process and other processes.

Therefore, an object of the present invention is to solve the abovementioned problems and to provide a soft magnetic material used to produce a powder compact having a high integrity, and a method of producing such a powder compact.

MEANS FOR SOLVING THE PROBLEMS

One possible approach to improve the integrity of the powder compact produced by pressure-forming of iron particles is improving the hardness and the integrity of the iron particles themselves constituting each powder compact. However, the inventors carried out comprehensive investigations and found that lowering the hardness of iron particles instead is effective to improve the integrity of the powder compact. Based on these findings, the inventors completed the present invention described below.

The soft magnetic material according to the present invention is a soft magnetic material used in production of a powder compact. This soft magnetic material contains a plurality of iron particles having a Vickers hardness HV of lower than 800. It should be noted that here the iron particles are particles containing iron at a purity from 95% to 100%.

In the soft magnetic material in the configuration described above, the iron particles have a Vickers hardness HV of lower than 800, and thus are easily plastically deformed in the pressure-forming process for producing a powder compact. This enables pressure-forming of the iron particles in such a manner that the particles are intricately entangled, thereby realizing a powder compact having a high integrity.

The iron particles preferably satisfy the relationship of $\alpha/\beta \geqq 2.5$, where $\alpha$ represents the specific surface area of the iron particles measured by a gas adsorption method (Brunauer-Emmett-Teller (BET) method) and $\beta$ represents the apparent specific surface area of the iron particles calculated from the average particle diameter measured by a laser diffraction/scattering method. In the soft magnetic material in this configuration, the ratio of the actual specific surface area a of the iron particles to the apparent specific surface area $\beta$ is specified as 2.5 or higher, and thus the surface of the iron particles has large convex and concave portions. As a result, the iron particles are entangled more intricately in the pressure-forming process for producing a powder compact, and the integrity of the resulting powder compact is further improved.

More preferably, the iron particles have a Vickers hardness HV of 700 or lower and satisfy the relationship of $\alpha/\beta \geqq 3.0$. In the soft magnetic material in this configuration, the abovementioned effect would be enhanced.

The soft magnetic material further contains insulating films covering the surface of the iron particles. In the soft magnetic material in this configuration, the insulating films existing in gaps between adjacent iron particles significantly inhibit metal bonds between the iron particles processed into a powder compact. Also, lubricity of the insulating films makes it impossible to couple the iron particles with each other intricately in the pressure-forming process for producing a powder compact. As a result, production of a powder compact having a high integrity becomes difficult. The present invention is thus suitably applied to the production process of such a soft magnetic material containing insulating films.

The average thickness of the insulating films is preferably 5 nm to 100 nm. In the soft magnetic material in this configuration, the tunnel current traveling in the films can be reduced as well as the gain in eddy current loss caused by this tunnel current can be reduced, because the average thickness of the insulating films is not less than 5 nm. At the same time, the average thickness of the insulating films is not more than 100 nm, so that in the powder compact obtained using this soft magnetic material, the distance between the iron particles is sufficiently short This can prevent generation of demagnetizing fields between the iron particles and thus can reduce the gain in hysteresis loss caused by the generation of those demagnetizing fields. Furthermore, the volume ratio of a nonmagnetic layer to the entire soft magnetic material can be reduced and loss in saturated magnetic flux density can be avoided.

The method of producing a powder compact according to the present invention is a method of producing a powder compact using any one of the soft magnetic materials described above. The method of producing a powder compact includes a step wherein iron particles are put into a mold, and a step wherein the iron particles are pressurized to produce a powder compact. In the method of producing a powder compact in this configuration, the iron particles are entangled intricately in the pressure-forming process for producing a powder compact, and the integrity of the resulting powder compact is improved.

The step wherein iron particles are put into a mold preferably includes a step wherein the first organic matter containing thermoplastic resin and/or non-thermoplastic resin is added into the iron particles so that the content ratio of the first organic matter to the entire compact is 0.001 weight percent (wt %) to 0.2 wt %. In the method of producing a powder compact in this configuration, the first organic matter is contained in the resulting powder compact so as to exist in gaps between the iron particles, thus coupling the iron particles with each other more firmly. This further improves the integrity of the obtained powder compact.

In this configuration, the content ratio of the first organic matter of 0.001 wt % or more would be sufficient for obtaining the effect described above. Also, the content ratio of the first organic matter of 0.2 wt % or less would enable reducing the volume ratio of a nonmagnetic layer to the entire powder compact and thereby reduce the loss in saturated magnetic flux density.

Furthermore, the step wherein iron particles are put into a mold preferably includes a step wherein the second organic matter containing a higher fatty acid-based lubricant is added into the iron particles so that the content ratio of the second organic matter to the entire compact is 0.001 wt % to 0.2 wt %. In the method of producing a powder compact in this configuration, the second organic matter is contained in the resulting powder compact so as to exist in gaps between adjacent iron particles, thus avoiding significant friction between the iron particles. This reduces the gain of hysteresis loss in the powder compact by distorting the inside of each iron particle. In the case where the surface of each iron particles is covered by an insulating film, destruction of the insulating film during the pressure-forming process is also avoided. This can reduce the eddy current loss in the resulting powder compact.

In this configuration, the content ratio of the second organic matter of 0.001 wt % or more would be sufficient for obtaining the effect described above. Also, the content ratio of the second organic matter of 0.2 wt % or less would enable reducing the volume ratio of a nonmagnetic layer to the entire powder compact and thereby reduce the loss in saturated magnetic flux density. Furthermore, high lubricity of the second organic matter can prevent the powder compact from deterioration of the integrity.

Moreover, the step wherein iron particles are put into a mold includes a step wherein a lubricant is applied on the inner wall of the mold. In the method of producing a powder compact in this configuration, favorable lubricity between the iron particles and the mold is achieved during the pressure-forming process. This can increase the density of the powder compact and further improve the integrity of the powder compact.

Additionally, the step wherein iron particles are put into a mold includes a step wherein the inner wall of the mold and/or the iron particles are heated to a temperature of 40° C. or higher. In the method of producing a powder compact in this configuration, the strain inside the iron particles can be reduced as well as the hysteresis loss in the powder compact. Furthermore, the first organic matter contained in the iron particles is softened so as to fill gaps between the particles sufficiently. This can increase the density of the powder compact and further improve the integrity of the powder compact.

EFFECTS OF THE INVENTION

As described above, the present invention provides a soft magnetic material used to produce a powder compact having a high integrity, and a method of producing such a powder compact.

REFERENCE NUMERALS

10 iron particle, 16 compact, 20 insulating film, 30 composite magnetic particle, 40 organic matter, 71 mold, 73 inner wall, 91 mold lubricant.

BEST MODS FOR CARRYING OUT THE INVENTION

Embodiments of the present invention are described below with reference to the drawings.

Figure 1:
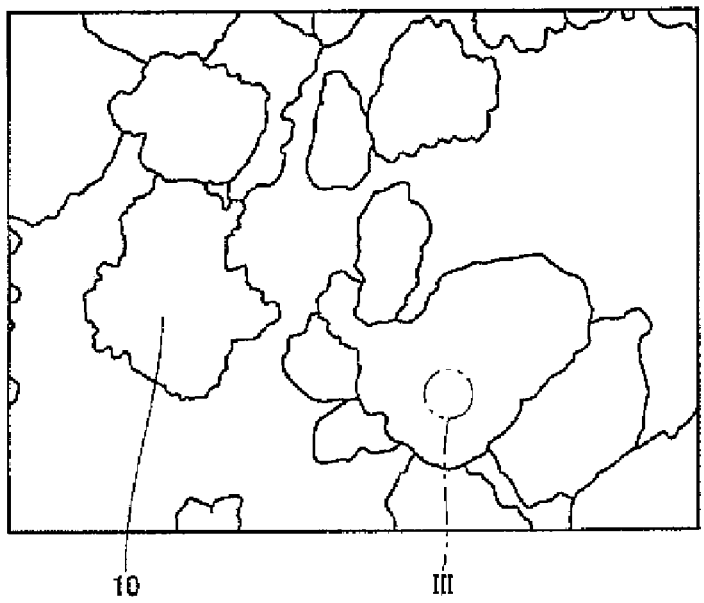
FIG. 1 is a schematic diagram of the soft magnetic material in an embodiment of the present invention.

Referring to FIG. 1, the soft magnetic material contains iron particles 10 having a Vickers hardness HV of less than 800. The Vickers hardness HV of the iron particles 10 is preferably 700 or less. The Vickers hardness HV of the iron particles 10 is measured using a test method for micro Vickers hardness stipulated in Japanese Industrial Standards (JIS) Z2244, for example, using the following method. In this description, an aggregate of the iron particles 10 is called iron powder.

Figure 2:
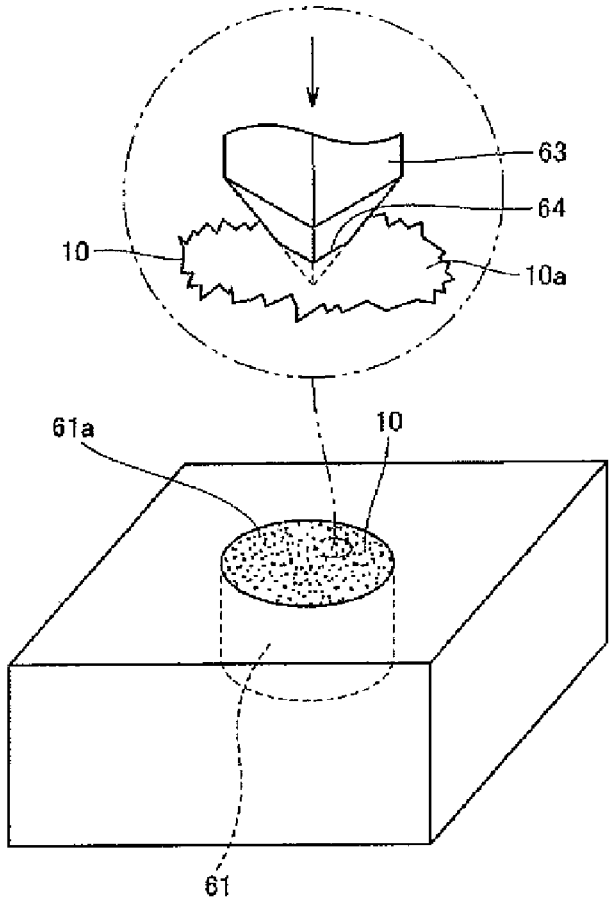
FIG. 2 is an illustration explaining a measurement method of the Vickers hardness HV of the iron particles shown in FIG. 1.

Referring to FIG. 2, the measurement method of the Vickers hardness HV of the iron particles shown in FIG. 1 is as follows. First, the iron powder is mixed with liquid resin or resin powder and then the mixture is heated (or undergoes a chemical reaction) until the resin is molten. After that, the molten resin is cured to produce resin 61 encapsulating the iron powder. Subsequently, the surface 61*a* of the resin 61 is subjected to lapping to form the planar section 10*a*, which is subjected to the hardness test, on the iron particles 10. A test pyramidal indenter 63 is pressed onto the planar section 10*a* with a test load of 0.5 N to form an indentation 64 in the surface of the iron particles 10. Then the diagonal length of the indentation 64 is measured for calculation of the Vickers hardness HV.

The iron particles 10 satisfy the relationship of $\alpha/\beta \geqq 2.5$, where $\alpha$ represents the specific surface area of the iron particles 10 and $\beta$ represents the apparent specific surface area of the iron particles 10. Preferably, the iron particles further meet the relationship of $\alpha/\beta \geqq 3.0$. The specific surface area $\alpha$ and the apparent specific surface area $\beta$ of the iron particles 10 can be determined according to the following method.

The specific surface area $\alpha$ of the iron particles 10 is measured by a gas adsorption method (a measurement method of a specific surface area using the BET equation derived from the BET method). More specifically, a gas of molecules having a known size (such as nitrogen gas and krypton gas) is adsorbed by the surface of the iron particles 10, and the specific surface area $\alpha$ ($m^2/g$) of the iron particles 10 is calculated from the amount of the adsorbed gas. In this method, the actual specific surface area $\alpha$ of the iron particles 10 can be determined by measuring the amount of the adsorbed gas over the surface of the iron particles 10.

On the other hand, the apparent specific surface area $\beta$ of the iron particles 10 is calculated from the average particle diameter D of the iron particles 10 measured by a laser diffraction/scattering method. First, a sample weighing a few tens of grams is collected from the iron powder containing the iron particles 10. The distribution of particle diameters in the sample is measured using a laser diffraction/scattering method, and then the average particle diameter D (m) is calculated from the histogram of the obtained particle diameter distribution. In this method, the average particle diameter D is a particle diameter in the histogram at which the accumulated weight of particles from those having a smaller diameter accounts for 50% of the overall weight, i.e., particle diameter D50.

Representing the true density of the iron particles 10 with k (g), the following equations hold:

$$\text{Surface area per iron particle } 10 = 4\times\pi\times(D/2)^2$$

$$\text{Volume per iron particle } 10 = 4/3\times\pi\times(D/2)^3$$

$$\text{Apparent surface area } \beta \text{ per gram of iron particles } 10 = (4\times\pi\times(D/2)^2)/(4/3\times\pi\times(D/2)^3\times k)$$

Thus the apparent specific surface area $\beta$ can be calculated using the equations above.

The specific surface area a calculated in this way is the actual value of the specific surface area of the iron particles 10 taking into account irregularities in the outline thereof and the surface texture, whereas the apparent specific surface area $\beta$ is based on the assumption that the iron particles 10 are perfect spheres having the average particle diameter D. Therefore, we can say that the iron particles 10 that satisfy the relationship of $\alpha/\beta \geqq 2.5$ used in this embodiment have many irregularities in the outline and a complicated surface texture.

Figure 3:
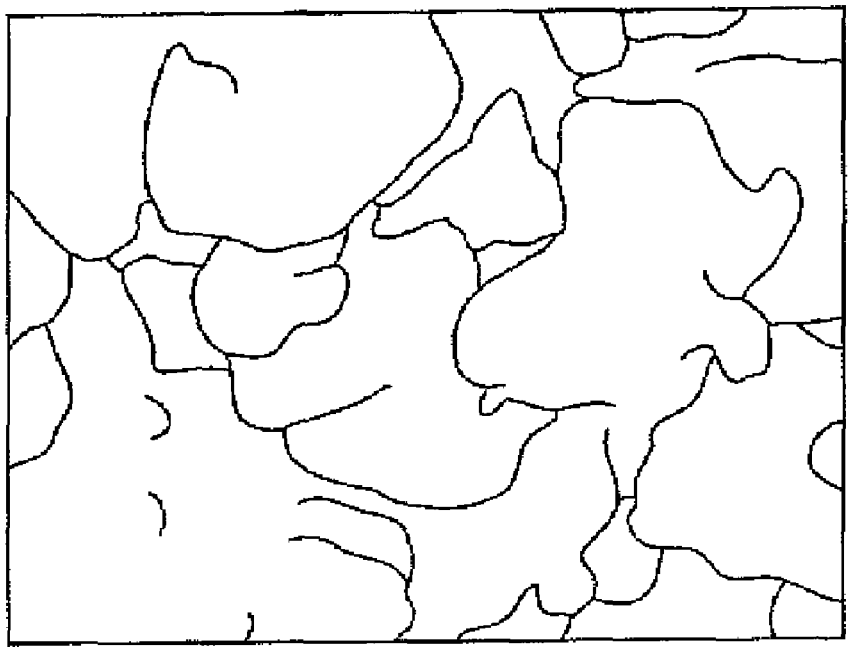
FIG. 3 is an enlarged diagram of the area surrounded by the chain double-dashed line III in FIG. 1.

Referring to FIGS. 1 and 3, the iron particles 10 that satisfy the relationship of $\alpha/\beta \geqq 2.5$ have an irregular shape with a jagged outline. Further, the iron particles 10 have a finely textured surface, thus the surface roughness being large.

Figure 4:
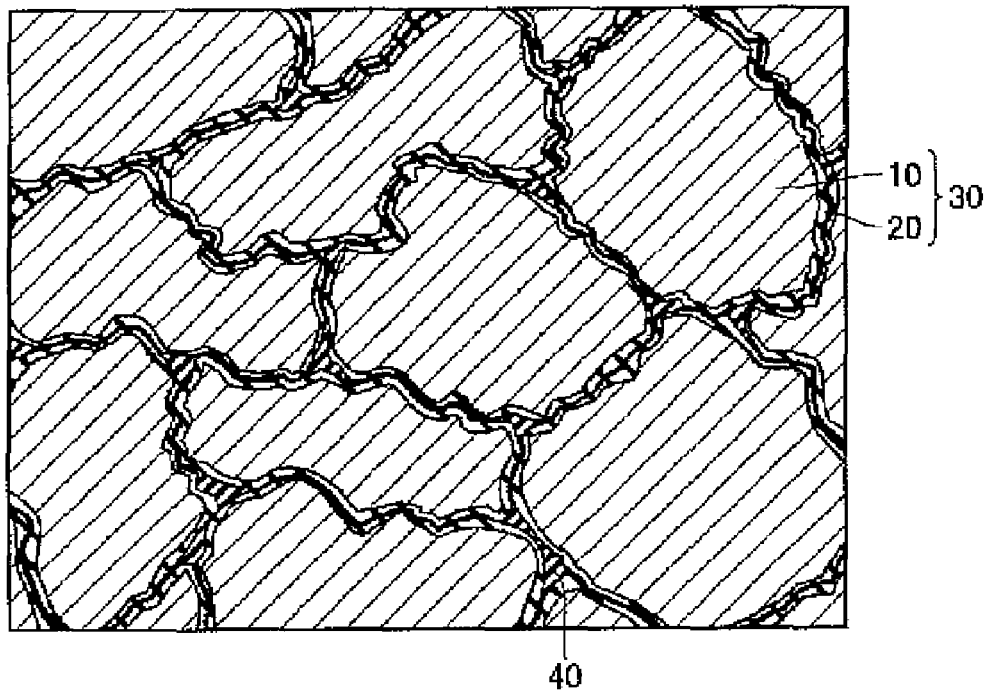
FIG. 4 is a schematic diagram of the surface of a dust core produced using the soft magnetic material shown in FIG. 1.

Referring to FIG. 4, the dust core produced using the soft magnetic material shown in FIG. 1 contains composite magnetic particles 30 that consist of the iron particles 10 and insulating films 20 covering the surface of the iron particles 10. In gaps between the composite magnetic particles 30, organic matter 40 exists. The composite magnetic particles 30 may be coupled with each other by engagement between convex and concave portions of the composite magnetic particles 30 themselves, or through the organic matter 40.

The irregular shape, large surface roughness and jagged outline of the iron particles 10 is transferred to the surface of the insulating films 20, so that the composite magnetic particles 30 are deformed so as to have an irregular shape, a large surface roughness and a jagged outline as well as the iron particles 10. Therefore, the composite magnetic particles 30 are coupled with each other via intricate entanglement and engagement, and this improves the integrity of the dust core.

Then, a method of producing the dust core shown in FIG. 4 by using the soft magnetic material according to the embodiments of the present invention is described below.

Figure 5:
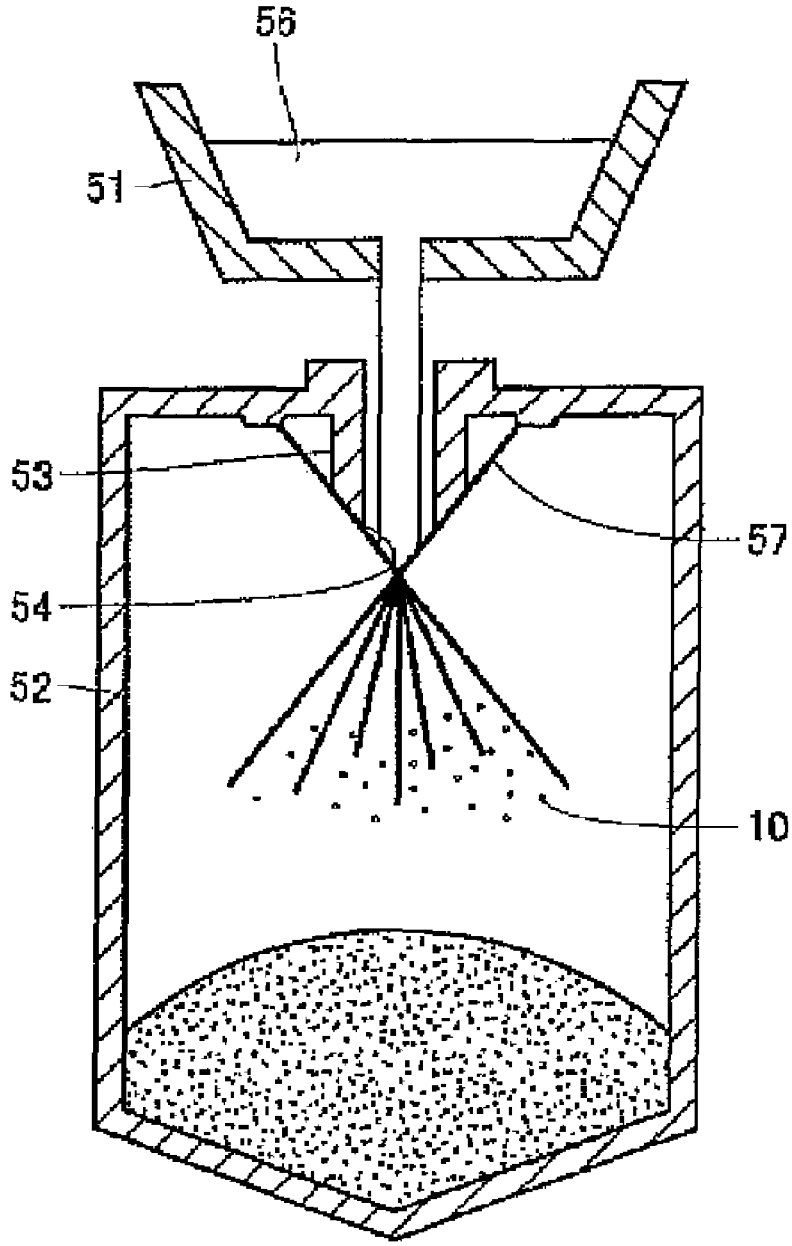
FIG. 5 is a sectional view of an atomizing device used to produce the soft magnetic material shown in FIG. 1.

Referring to FIG. 5, iron masses to be used as a material of the iron particles are first put into a vacuum induction furnace 51, and then a high-frequency power is applied to the vacuum induction furnace 51. This makes the iron masses in the vacuum induction furnace 51 be fused into the molten liquid 56. The molten liquid 56 is poured into the molten liquid introduction tube 53 while spraying pressurized water 57 to the spray nozzle 54. The molten liquid 56 is atomized by the sprayed pressurized water 57, and rapidly cooled in the spray tower 52 to form iron powder consisting of the iron particles 10.

In the process described above, lowering the cooling rate in the spray tower 52 and reducing the content ratio of elements that may increase the hardness (in particular, nitrogen, carbon, phosphorous and manganese) to the iron particles 10 result in the iron particles 10 having a Vickers hardness HV of lower than 800. Furthermore, the iron powder may be heated to a temperature of at least 500° C. under a hydrogen or inert gas atmosphere after the abovementioned atomizing process. This can release the strain and the stress existing inside the iron particles 10, thus reducing the hardness of the iron particles 10.

In the atomizing process described above, it is also possible to deform the iron particles 10 so as to have an irregular shape, a large surface roughness and a jagged outline by appropriate adjustment of the conditions such as the pressure of water spray and the water temperature. The larger particle diameter the iron particles 10 have, the more complicated the surface texture of the iron particles 10 is. In addition, use of an atomizing method using water results in a more complicated texture being formed on the surface of the iron particles 10 than use of an atomizing method using a gas.

As the next step, the obtained iron powder is treated with phosphoric acid to form the insulating films 20 on the surface of the iron particles 10, thus producing the composite magnetic particles 30. These insulating films 20 are positioned between the iron particles 10 so as to serve as an insulating layer. Covering the iron particles 10 with the insulating films 20 can improve the electrical resistance ρ of the resulting dust core. This can prevent an eddy current from passing through the iron particles 10 and as a result, the iron loss in the dust core caused by the eddy current can be reduced.

In addition, the insulating films 20 may contain oxides. Several kinds of materials may be used for forming the insulating films 20 containing oxides, for example, iron phosphate having phosphorous and iron, manganese phosphate, zinc phosphate, calcium phosphate and aluminum phosphate, as well as oxide insulators such as silicon oxide, titanium oxide, aluminum oxide and zirconium oxide. The insulating films 20 may consist of a single layer, as shown in the drawing, or a plurality of layers.

Furthermore, the average thickness of the insulating films 20 is preferably 5 nm to 100 nm. This average thickness is determined by calculating the equivalent thickness from the film composition obtained by a composition analysis (transmission electron microscope energy dispersive X-ray spectroscopy (TEM-EDX)) and the element content obtained by inductively coupled plasma-mass spectrometry (ICP-MS) and then performing direct visual observation of the film on a TEM image to confirm that the calculated equivalent thickness is of the correct order of magnitude.

Then, the first organic matter to be used as an integrity enhancer, which consists of thermoplastic resin and non-thermoplastic resin, and the second organic matter to be used as a lubricant, which consists of a higher fatty acid-based lubricant, are prepared as the organic matter 40. Examples of the first organic matter include thermoplastic resin such as thermoplastic polyimide, thermoplastic polyamide, thermoplastic polyamide-imide, polyphenylene sulfide, polyamide-imide, polyethersulfone, polyetherimide and polyetheretherketone, as well as non-thermoplastic resin such as high-molecular-weight polyethylene, wholly aromatic polyester and wholly aromatic polyimide. It should be noted that this high-molecular-weight polyethylene represents polyethylene whose molecular weight is 100,000 or more. Examples of the second organic matter include zinc stearate, lithium stearate, calcium stearate, magnesium stearate, lithium palmitate, calcium palmitate, lithium oleate, calcium oleate and other higher fatty acid-based compounds.

The composite magnetic particles 30 and the organic matter 40 are mixed using a V-type mixer. In the mixing process, the amounts of the first and second organic matter to be mixed are separately adjusted so that their content ratios account for 0.001 wt % to 0.2 wt % of the expected weight of the compact produced in a subsequent process. In addition, the organic matter 40 may consist of both or either the first and second organic matter. There is no specific limitation on the mixing technique, and any technique such as mechanical alloying, vibratory ball milling, planetary ball milling, mechanofusion, coprecipitation, chemical vapor deposition (CVD), physical vapor deposition (PYD), plating, sputtering, vapor deposition and sol-gel process may be used.

Figure 6:
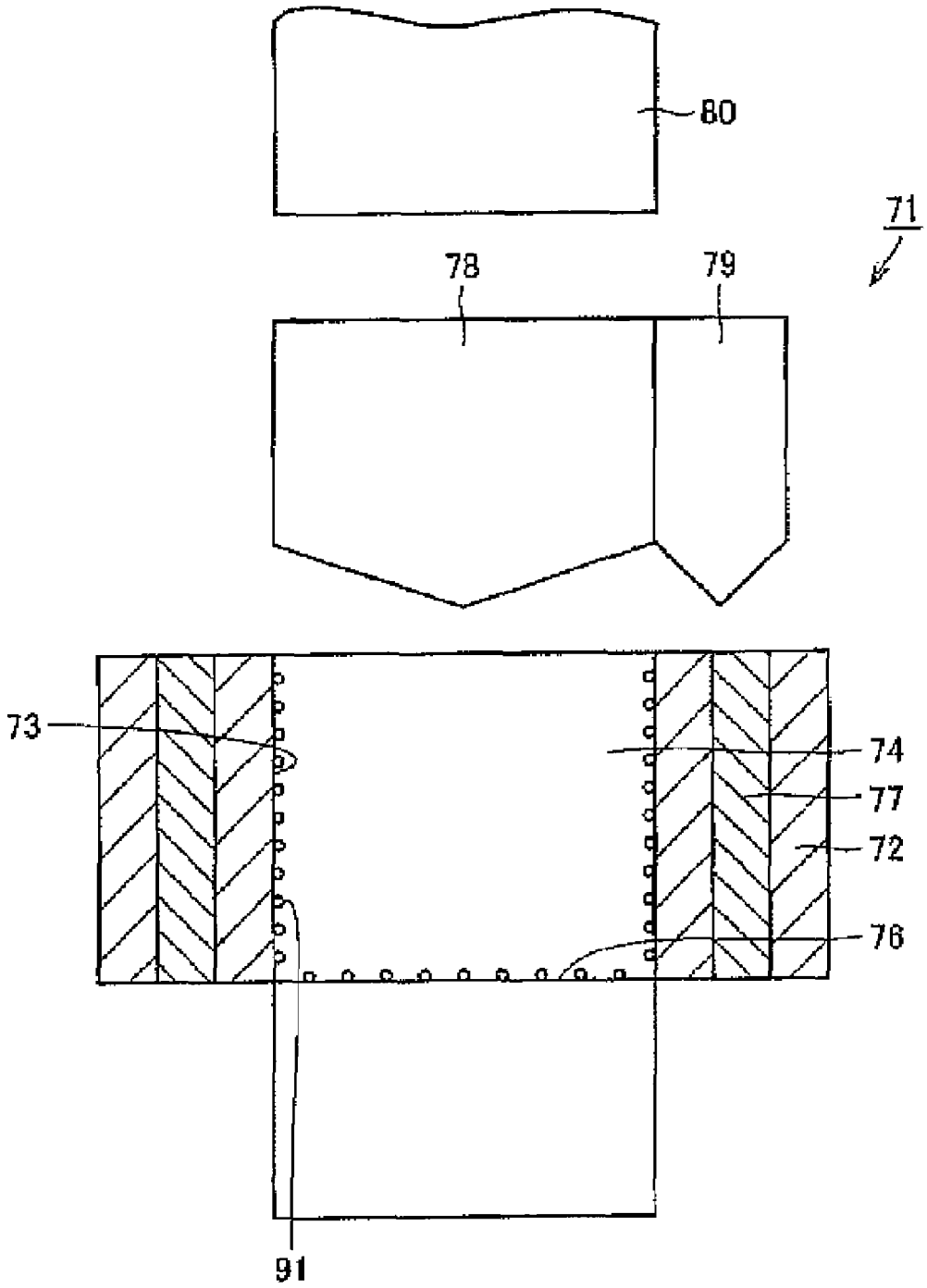
FIG. 6 is a sectional view showing the first step of the pressure-forming process for producing the dust core shown in FIG. 4.

The obtained powder mixture is then subjected to pressure-forming. Referring to FIG. 6, the band heater 77 placed in the mold 71 is turned on to heat the inner wall 73 of the die 72 to a temperature of at least 40° C. The powder mixture obtained in the previous step may be heated instead of the inner wall 73, or both the inner wall 73 and the powder mixture may be heated. Preferably, these components are heated to a temperature from 80° C. to 200° C.

Subsequently, a lubricant introduction portion 78 is positioned above the space 74 surrounded by the inner wall 73. From the spray nozzle of this lubricant introduction portion 78, a mold lubricant 91 is sprayed into the space 74 using compressed air. This makes the mold lubricant 91 adhere to the inner wall 73 and the bottom 76 of the mold 71. Though the mold lubricant 91 is schematically illustrated as powder in the drawing, the mold lubricant 91 may be a liquid, and the adhesion technique may be either a wet or a dry technique. Examples of the mold lubricant 91 include metal soap, polyethylene, amide wax, polyamide, polypropylene, polyacrylate, polymethacrylate, fluororesin and a layered lubricant. In addition, a combined lubricant obtained by mixing any two or more kinds of the abovementioned material may be used.

Figure 7:
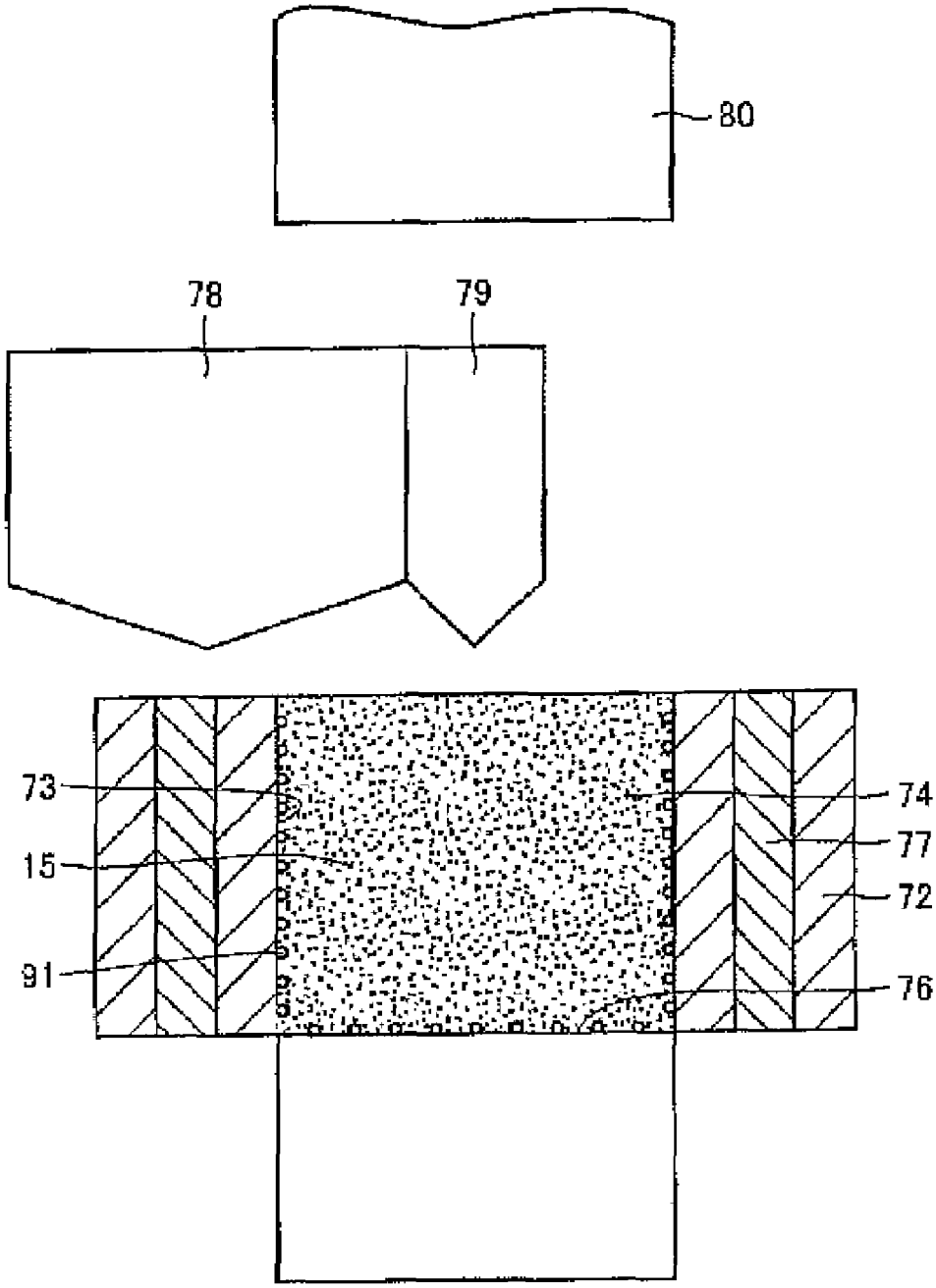
FIG. 7 is a sectional view showing the second step of the pressure-forming process for producing the dust core shown in FIG. 4.
Figure 8:
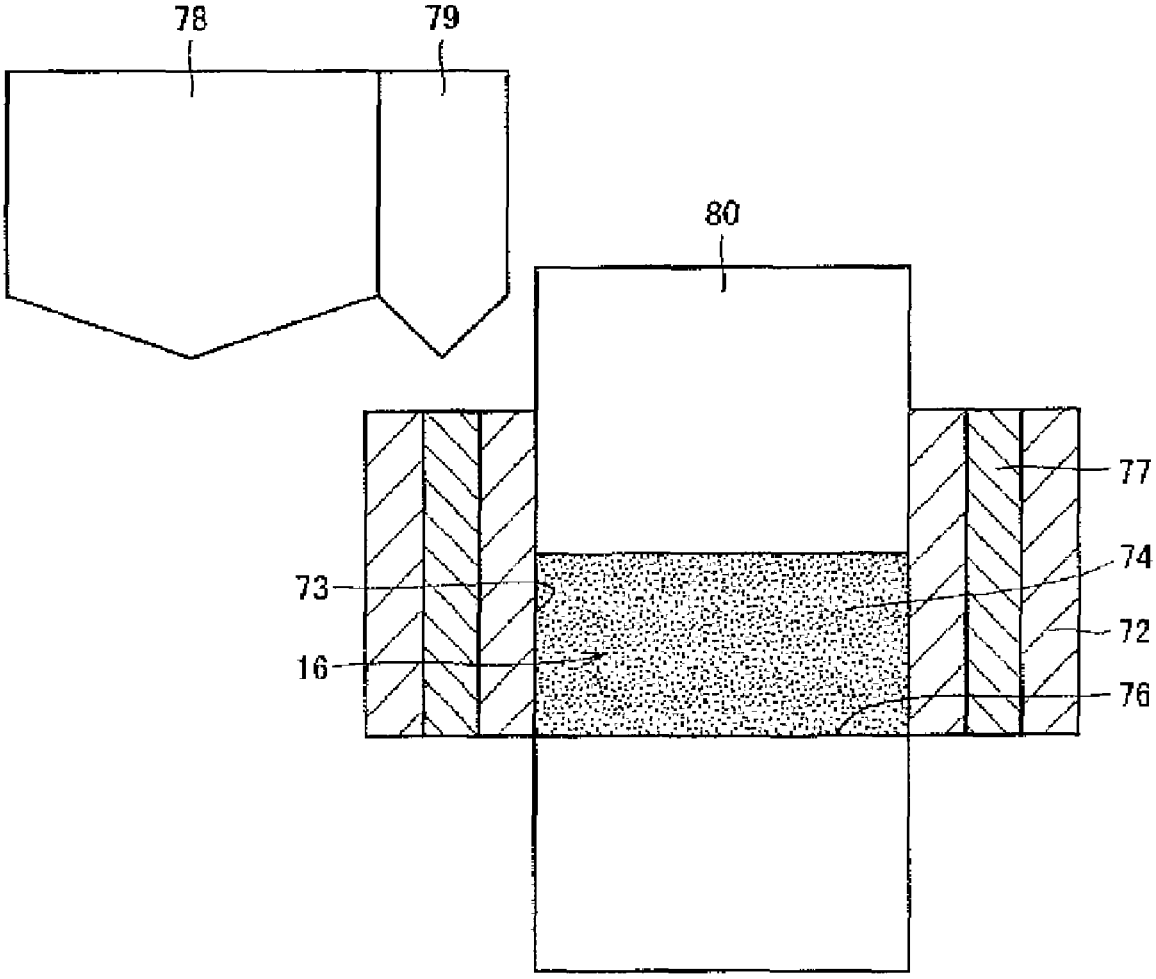
FIG. 8 is a sectional view showing the third step of the pressure-forming process for producing the dust core shown in FIG. 4.

Referring to FIG. 7, a shoe 79 is positioned above the space 74, and then the powder mixture 15 obtained in the previous step is introduced to the space 74 from the shoe 79. Referring to FIG. 8, an upper punch 80 is positioned above the space 74. The upper punch 80 is then lowered to press the powder mixture 15 under a certain pressure, for example, from 700 MPa to 1500 MPa. During this pressure-forming process, the ambient atmosphere is preferably an inert gas or under reduced pressure. This can prevent the powder mixture from being oxidized due to oxygen in the air.

In this pressure-forming process, the organic matter 40 serves as a lubricant in the interface between the adjacent composite magnetic particles 30 mainly by the effect of the second organic matter contained therein. This avoids introduction of strain to the iron particles 10 and destruction of the insulating films 20 caused by excessive friction during the pressure-forming process.

After that, the compact 16 obtained by pressure-forming is removed from the space 74. The compact 16 is then heated at a temperature higher than the glass transition temperature of the organic matter 40 and not more than the thermal decomposition temperature of the organic matter 40. At a temperature in this range, the organic matter 40 can be protected from thermal decomposition and fill gaps between the composite magnetic particles 30 sufficiently. This can reinforce the bonds between the composite magnetic particles 30, thus improving the integrity of the compact 16 mainly by the effect of the first organic matter contained in the organic matter 40. The heating process can also remove the strain and the dislocation that have occurred inside the compact 16 during the pressure-forming process.

Finally, the compact 16 is subjected to extrusion, cutting-off or other appropriate treatments, and thus the dust core shown in FIG. 1 is completed.

In the soft magnetic material and the method of producing a dust core in this configuration, the iron particles 10 can be plastically deformed with ease in the pressure-forming process, because of the low hardness of iron particles 10 with the Vickers hardness HV of less than 800. Therefore, the composite magnetic particles 30 are coupled with each other through intricate entanglement, and thus the bonds between them are reinforced. This can improve the integrity of the compact 16 produced in the pressure-forming process and enables processing of the compact 16, for example, to cut off the compact 16, without any damage thereto.

In addition, the dust core produced in this way can be used in a wide variety of products including electronics such as a choke coil, a switching power device and a magnetic head, components of a motor, solenoids for automobiles, magnetic sensors and solenoid valves. Besides the magnetic components such as the dust core produced in this embodiment, any other type of common powder compacts, for example, those used as mechanical components, can be fabricated.

EXAMPLES

The soft magnetic material and the method of producing a powder compact according to the present invention were evaluated using the following examples.

Example 1

Several types of iron powder with a known Vickers hardness HV were prepared, and the specific surface area α and the apparent specific surface area β of iron particles 10 constituting each type of iron powder were measured according to the method described in the embodiments above. In this Vickers hardness measurement, a micro Vickers hardness meter was used with the test load being 0.5 N. In addition, a krypton gas was used in gas adsorption for the measurement of the specific surface area α.

Then, a wet coating technique referred to as Bonderite coating, wherein an iron phosphate solution is used, was applied to some types of iron powder to form the iron phosphate films acting as the insulating films 20 on the surface of the iron particles 10, thus producing the composite magnetic particles 30. The thickness of the insulating films 20 was adjusted by changing the concentration of the solution.

Subsequently, the obtained composite magnetic particles 30 and the remaining types of iron powder, i.e., those without the insulating films 20, were pressure-formed under a pressure of 1275 MPa (=13 tons/cm$^2$) to produce compacts, which were designated as Samples A to V. The density of the compacts was 7.5 g/cm$^3$, and the shape of the compacts was the same as that of 20-mm JIS samples in accordance with the specifications of JIS transverse test. The transverse strength of the compacts obtained in the steps described above was measured by carrying out the transverse test according to JIS. The measured values of the transverse strength accompanied by data of the iron particles 10 and the insulating films 20 constituting each sample compact are shown in Table I.

TABLE I

| | Sample name | Vickers hardness HV of iron particles | α/β | Material of insulating films | Thickness of insulating films (nm) | Transverse strength (MPa) |
|---|---|---|---|---|---|---|
| Comparative Example | A | 1030 | 2.82 | None | | 56 |
| | B | 940 | 2.95 | None | | 65 |
| | C | 880 | 4.53 | None | | 114 |
| | D | 850 | 3.82 | None | | 105 |
| | E | 830 | 2.57 | None | | 86 |
| Example | F | 780 | 2.92 | None | | 149 |
| | G | 730 | 4.28 | None | | 159 |
| | H | 740 | 3.08 | None | | 150 |
| | I | 760 | 2.43 | None | | 132 |
| | J | 730 | 2.25 | None | | 130 |
| | K | 680 | 2.83 | None | | 164 |
| Comparative Example | L | 1000 | 2.82 | Iron phosphate | 25 | 38 |
| | M | 960 | 2.95 | Iron phosphate | 27 | 44 |
| | N | 850 | 4.53 | Iron phosphate | 21 | 76 |
| | O | 830 | 3.82 | Iron phosphate | 30 | 72 |
| | P | 840 | 2.57 | Iron phosphate | 26 | 57 |
| Example | Q | 770 | 2.81 | Iron phosphate | 26 | 98 |
| | R | 750 | 4.28 | Iron phosphate | 20 | 113 |
| | S | 740 | 3.12 | Iron phosphate | 22 | 107 |
| | T | 750 | 2.43 | Iron phosphate | 28 | 90 |
| | U | 720 | 2.25 | Iron phosphate | 32 | 86 |
| | V | 670 | 2.83 | Iron phosphate | 28 | 118 |

As seen in Table I, high transverse strengths were achieved in the samples wherein the Vickers hardness HV of the iron particles 10 was less than 800, with or without the insulating films 20. Furthermore, the samples having a value of α/β of not less than 2.5 exhibited a higher transverse strength than other samples having a similar Vickers hardness HV.

Example 2

The composite magnetic particles 30 were prepared by forming several types of insulating films 20 on the surface of the iron powder used to prepare the compact of Sample F in Example 1, while changing the thickness of the insulating films. In a similar way to that in Example 1, the compacts having the same shape as that of the abovementioned JIS samples were produced from the obtained composite magnetic particles 30, and designated as Samples 1 to 20. Additionally, ring-shaped compacts were produced from the same composite magnetic particles 30 and designated as Samples 1 to 20.

As for the compacts having the same shape as that of the JIS samples, the transverse test was performed in a similar way to that in Example 1 in order to measure the transverse strength of each compact. As for the ring-shaped compacts, their eddy current loss factor was measured in a magnetic field wherein the magnetic field strength was up to 1 Tesla (T). The measured values of the transverse strength and the eddy current loss factor accompanied by data of the iron particles 10 and the insulating films 20 constituting each sample compact are shown in Table II. In addition, the presence of values in the "First layer of insulating films," "Second layer of insulating films" and "Third layer of insulating films" columns in the table means that the insulating films 20 were formed using one layer, two layers and three layers, respectively.

TABLE II

| Sample name | Vickers hardness HV of iron particles | α/β | First layer of insulating films Material | Thickness (nm) | Second layer of insulating films Material | Thickness (nm) | Third layer of insulating films Material | Thickness (nm) | Total thickness of insulating films (nm) | Transverse strength (MPa) | Eddy current loss factor ($mWs^2/kg$) |
|---|---|---|---|---|---|---|---|---|---|---|---|
| 1 | 780 | 2.92 | Iron phosphate | 3 | | | — | | 3 | 101 | 0.042 |
| 2 | | | Iron phosphate | 6 | | | — | | 6 | 98 | 0.033 |
| 3 | | | Iron phosphate | 25 | | | — | | 25 | 95 | 0.034 |
| 4 | | | Iron phosphate | 59 | | | — | | 59 | 94 | 0.031 |
| 5 | | | Iron phosphate | 87 | | | — | | 87 | 95 | 0.033 |
| 6 | | | Iron phosphate | 97 | | | — | | 97 | 98 | 0.031 |
| 7 | | | Iron phosphate | 110 | | | | | 110 | 87 | 0.028 |
| 8 | | | Iron phosphate | 135 | | | — | | 135 | 83 | 0.027 |
| 9 | | | Aluminum phosphate | 38 | | | — | | 38 | 94 | 0.032 |
| 10 | | | Aluminum phosphate | 69 | | | — | | 69 | 96 | 0.035 |
| 11 | | | Iron phosphate | 2 | Silica | 2 | | — | 4 | 99 | 0.040 |
| 12 | | | Aluminum phosphate | 10 | Silica | 54 | | — | 64 | 93 | 0.035 |
| 13 | | | Aluminum phosphate | 30 | Silica | 85 | | — | 115 | 89 | 0.030 |
| 14 | | | Aluminum phosphate | 12 | Alumina | 64 | | — | 76 | 93 | 0.034 |
| 15 | | | Iron phosphate | 2 | Silica | 35 | Alumina | 5 | 42 | 97 | 0.036 |
| 16 | | | Iron phosphate | 25 | Aluminum phosphate | 7 | Silica | 30 | 62 | 96 | 0.033 |
| 17 | | | Iron phosphate | 35 | Aluminum phosphate | 23 | Silica | 15 | 73 | 96 | 0.032 |
| 18 | | | Iron phosphate | 13 | Aluminum phosphate | 34 | Silica | 28 | 75 | 98 | 0.033 |
| 19 | | | Iron phosphate | 35 | Aluminum phosphate | 56 | Silica | 24 | 115 | 88 | 0.028 |
| 20 | | | Iron phosphate | 68 | Aluminum phosphate | 5 | Silica | 11 | 84 | 94 | 0.034 |

Referring to Table II, the insulating films 20 having a thickness smaller than 5 nm provided only insufficient reduction of the eddy current loss factor. On the other hand, the insulating films 20 having a thickness larger than 100 nm reduced the eddy current loss factor sufficiently, but also reduced the transverse strength slightly. This may be due to the fact that, the texture of the iron particles 10 could not be transferred to the surface of the insulating films 20 since the thickness of the insulating films 20 was excessively large, and as a result, entanglement of the composite magnetic particles 30 was also insufficient. In contrast, the samples wherein the thickness of the insulating films 20 was 5 nm to 100 nm achieved both an excellent integrity and a decreased eddy current loss factor.

Example 3

Several kinds of organic matter were mixed with the composite magnetic particles 30 used to prepare the compact of Sample Q in Example 1, while changing the content of the organic matter. In a similar way to that in Example 1, the compacts having the same shape as that of the JIS samples and the ring-shaped compacts were produced from the obtained powder mixture, and designated as Samples 1 to 26. The produced compacts were then heated at a temperature of not less than the glass transition temperature of the added organic matter.

In a similar way to that in Example 2, the transverse strength of the compacts having the same shape as that of the JIS samples was measured, and the eddy current loss factor of the ring-shaped compacts was measured. The measured values of the transverse strength and the eddy current loss factor accompanied by data of the organic matters added in each sample compact are shown in Table III. In addition, "Added resin" in the table corresponds to the first organic matter to be used as an integrity enhancer described in the embodiments above, and "Lubricant" corresponds to the second organic matter used as a lubricant described in the embodiments above.

TABLE III

| Sample name | Vickers hardness HV of iron particles | Insulating films Material | Insulating films Thickness (nm) | α/β | Added resin Material | Added resin Content ratio to the compact (wt %) | Lubricant Material | Lubricant Content ratio to the compact (wt %) | Transverse strength (MPa) | Eddy current loss factor ($mWs^2/kg$) |
|---|---|---|---|---|---|---|---|---|---|---|
| 1 | 770 | Iron phosphate | 26 | 2.81 | Polyethylene | 0.0008 | — | — | 97 | 0.038 |
| 2 | | | | | Polyethylene | 0.002 | — | — | 113 | 0.038 |
| 3 | | | | | Polyethylene | 0.01 | — | — | 125 | 0.035 |
| 4 | | | | | Polyethylene | 0.05 | — | — | 129 | 0.034 |
| 5 | | | | | Polyethylene | 0.10 | — | — | 137 | 0.035 |
| 6 | | | | | Polyethylene | 0.10 | Zinc stearate | 0.0008 | 138 | 0.035 |
| 7 | | | | | Polyethylene | 0.10 | Zinc stearate | 0.002 | 136 | 0.028 |
| 8 | | | | | Polyethylene | 0.10 | Zinc stearate | 0.01 | 132 | 0.026 |
| 9 | | | | | Polyethylene | 0.10 | Zinc stearate | 0.06 | 130 | 0.024 |
| 10 | | | | | Polyethylene | 0.10 | Zinc stearate | 0.10 | 131 | 0.022 |
| 11 | | | | | Polyethylene | 0.10 | Zinc stearate | 0.18 | 133 | 0.022 |
| 12 | | | | | Polyethylene | 0.10 | Zinc stearate | 0.25 | 104 | 0.022 |
| 13 | | | | | Polyethylene | 0.10 | Zinc stearate | 0.35 | 98 | 0.021 |
| 14 | | | | | Polyethylene | 0.18 | — | — | 139 | 0.036 |
| 15 | | | | | Polyethylene | 0.25 | — | — | 140 | 0.035 |
| 16 | | | | | Polyethylene | 0.35 | — | — | 142 | 0.034 |
| 17 | | | | | 6-12 Nylon | 0.0008 | — | — | 96 | 0.035 |
| 18 | | | | | 6-12 Nylon | 0.002 | — | — | 119 | 0.034 |
| 19 | | | | | 6-12 Nylon | 0.10 | Zinc stearate | 0.10 | 138 | 0.030 |
| 20 | | | | | 6-12 Nylon | 0.10 | Lithium stearate | 0.10 | 140 | 0.034 |
| 21 | | | | | 6-12 Nylon | 0.25 | — | — | 144 | 0.039 |
| 22 | | | | | Thermoplastic polyimide | 0.005 | — | — | 146 | 0.033 |
| 23 | | | | | Thermoplastic polyimide | 0.06 | — | — | 151 | 0.030 |
| 24 | | | | | Thermoplastic polyimide | 0.15 | — | — | 151 | 0.033 |
| 25 | | | | | Thermoplastic polyamide | 0.05 | — | — | 156 | 0.028 |
| 26 | | | | | Thermoplastic polyamide | 0.15 | — | — | 159 | 0.034 |

As seen in Table III, adding an appropriate amount of resin and a lubricant into the compacts resulted in improved transverse strength and decreased eddy current loss factor, respectively. This confirmed that the compacts containing an appropriate combination of resin and a lubricant have both a considerable integrity and excellent magnetic characteristics.

In addition, applying a lubricant on the inner wall of the mold before the pressure-forming process would improve the integrity of the resulting compacts by up to 10%. Also, heating the inner wall of the mold and the powder to be introduced to the mold to a temperature from 80° C. to 200° C. would further improve the integrity of the resulting compacts by up to 10%. The integrity of the resulting compacts can be farther enhanced by combining the two treatments described above.

The embodiments and examples disclosed herein should be considered as illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is applicable in manufacturing motor cores, solenoid valves, reactors or other electromagnetic components produced by pressure-forming of soft magnetic powder.

The invention claimed is:

1. A soft magnetic material used for producing a powder compact, comprising:

a plurality of iron particles having a Vickers hardness HV of less than 800 and satisfying the relationship of $\alpha/\beta \geqq 2.5$, where α represents the specific surface area of the iron particles measured by a gas adsorption method (Brunauer-Emmett-Teller (BET) method) and β represents the apparent specific surface area of the iron particles calculated from the average particle diameter measured by a laser diffraction/scattering method.

2. The soft magnetic material according to claim 1, wherein the Vickers hardness HV of the iron particles is not more than 700.

3. The soft magnetic material according to claim 1, wherein the iron particles further satisfy the relationship of $\alpha/\beta \geqq 3.0$.

4. The soft magnetic material according to claim 1, further comprising insulating films covering the surface of the iron particles.

5. The soft magnetic material according to claim 4, wherein the average thickness of the insulating films is 5 nm to 100 nm.

6. A method of producing a powder compact by using the soft magnetic material according to claim 1, comprising a step of putting the plurality of iron particles into a mold, and a step of pressure-forming the plurality of iron particles to produce a compact.

7. The method of producing a powder compact according to claim 6, wherein the step of putting the plurality of iron particles into the mold comprises a step of adding first organic matter comprising at least one of thermoplastic resin and non-thermoplastic resin to the plurality of iron particles so that the content ratio of the first organic matter to the compact is 0.001 wt % to 0.2 wt %.

8. The method of producing a powder compact according to claim 6, wherein the step of putting the plurality of iron particles into the mold comprises a step of adding second organic matter comprising a higher fatty acid-based lubricant to the plurality of iron particles so that the content ratio of the second organic matter to the compact is 0.001 wt % to 0.2 wt %.

9. The method of producing a powder compact according to claim 6, wherein the step of putting the plurality of iron particles into the mold comprises a step of applying a lubricant on an inner wall of the mold.

10. The method of producing a powder compact according to claim 6, wherein the step of putting the plurality of iron particles into the mold comprises a step of heating at least one of an inner wall of the mold and the plurality of iron particles to a temperature of not less than 40° C.

* * * * *